US010367271B1

(12) United States Patent
Wu

(10) Patent No.: US 10,367,271 B1
(45) Date of Patent: Jul. 30, 2019

(54) TERMINAL BLOCK WITH LATERAL ELASTIC HANDLES

(71) Applicants: DINKLE ENTERPRISE CO., LTD., New Taipei (TW); DINKLE ELECTRIC MACHINERY (CHINA) CO., LTD., Kunshan, Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Kunshan, Jiangsu (CN)

( * ) Notice: Subject to any disclaimer, the term of this patent is extended or adjusted under 35 U.S.C. 154(b) by 0 days.

(21) Appl. No.: 16/196,164

(22) Filed: Nov. 20, 2018

(51) Int. Cl.
*H01R 4/24* (2018.01)
*H01R 4/48* (2006.01)
*H01R 9/24* (2006.01)

(52) U.S. Cl.
CPC ..... *H01R 4/4836* (2013.01); *H01R 9/24* (2013.01); *H01R 9/2491* (2013.01)

(58) Field of Classification Search
CPC ..... H01R 4/4818; H01R 4/52; H01R 13/514; H01R 9/24; H01R 4/4845; H01R 4/4809; H01R 13/2442
USPC ..... 439/436–441, 701, 709, 835, 861–862
See application file for complete search history.

(56) References Cited

U.S. PATENT DOCUMENTS 4,759,726 A * 7/1988 Naylor ..... H01R 4/5008 439/441
5,915,991 A * 6/1999 Roman ..... H01R 4/4827 439/441
6,146,187 A * 11/2000 Pallai ..... H01R 4/4836 439/431
6,261,120 B1 * 7/2001 Beege ..... H01R 4/4836 439/268
6,712,649 B2 * 3/2004 Mano ..... H01R 4/4845 439/441

(Continued)

FOREIGN PATENT DOCUMENTS

DE 3743410 A1 6/1989
DE 19949387 A1 5/2001
EP 1094551 A1 4/2001

OTHER PUBLICATIONS

Search report dated May 23, 2019 of the corresponding European patent application.

*Primary Examiner* — Thanh Tam T Le
(74) *Attorney, Agent, or Firm* — Chun-Ming Shih; HDLS IPR Services

(57) ABSTRACT

A terminal block has an insertion opening (101) and an exit opening (102) disposed at opposite sides of the insulation base (10). A side opening (103) is located at an outer surface of the insulation base (10) between the insertion opening (101) and the exit opening (102). A conducting terminal structure (20) includes a first conductive sheet (21) and a second conductive sheet (22) connected to the first conductive sheet (21). The first conductive sheet (21) is extended with a stopping plate (211). A spring plate (30) includes an abutting section (31) abutted against the stopping plate (211) elastically. An elastic handle includes a clamping portion (41) and a resilience arm (42). The resilience arm (42) is fixed to the insulation base (10), and the clamping portion (41) presses the abutting section (31). Thereby, the height of the terminal block can be reduced for saving space and cost.

17 Claims, 8 Drawing Sheets

(56) References Cited

U.S. PATENT DOCUMENTS

| | | | | |
|---|---|---|---|---|
| 8,251,738 | B2 * | 8/2012 | Heckert | H01R 4/4836 439/441 |
| 8,342,891 | B2 * | 1/2013 | Fukushi | H01R 4/4836 439/752 |
| 8,408,952 | B2 * | 4/2013 | Wu | H01R 4/4818 439/441 |
| 8,485,841 | B2 * | 7/2013 | Schrader | H01R 4/4827 439/441 |
| 8,579,651 | B2 * | 11/2013 | Hanning | H01R 4/4836 439/441 |
| 8,851,920 | B2 * | 10/2014 | Wu | H01R 4/4827 439/441 |
| 9,240,650 | B2 * | 1/2016 | Wu | H01R 4/48 |
| 9,397,444 | B1 | 7/2016 | Wu | |
| 9,466,897 | B1 | 10/2016 | Wu | |
| 9,502,795 | B1 * | 11/2016 | Wu | H01R 4/4827 |
| 9,525,216 | B2 * | 12/2016 | Wu | H01R 4/4809 |
| 10,003,142 | B1 * | 6/2018 | Lin | H01R 4/4836 |
| 10,153,564 | B1 * | 12/2018 | Wu | H01R 9/26 |

* cited by examiner

TERMINAL BLOCK WITH LATERAL ELASTIC HANDLES

BACKGROUND OF THE INVENTION

Field of the Invention

The present invention generally relates to terminal blocks and, in particular to a terminal block with elastic handles.

Description of Prior Art

Terminal blocks are electrical connecting devices composed of an insulation seat, spring plate and conductive elements which are provided as a working platform for electrically connecting with a plurality of wires. Moreover, terminal blocks are used in a wide range of applications, such as electrical appliances (for example, air conditioners, refrigerators, washing machines, or ovens), mechanical equipment (such as industrial computers, uninterruptible power systems, power supplies etc.) or engineering control equipment (such as electromechanical systems, refrigerated air conditioners or programmable controllers, etc.) and other devices, or data transmission cables etc. . . . .

Furthermore, some terminal blocks are provided with elastic handles for pressing the spring plate in the insulation seat so as to facilitate the insertion of cables to perform the electricity connection. However, most of the existing elastic handles are placed at the insertion opening of the terminal blocks; therefore, the elastic handles are higher than the terminal block by a certain distance and that will lead to a substantial increase in the overall height of the terminal block, and the overall height of the product will be affected.

In view of the above drawbacks, the Inventor proposes the present invention based on his expert knowledge and elaborate researches in order to solve the problems of prior art.

SUMMARY OF THE INVENTION

Accordingly, an object of the present invention is to provide a terminal block with lateral elastic handles to reduce the height of the terminal block for saving space and cost.

In order to achieve the object mentioned above, the present invention provides a terminal block with lateral elastic handles for inserting at least one cable comprising an insulation base, at least one conducting terminal structure, at least one spring plate and at least one elastic handle. The insulation base has at least one accommodating space, and an insertion opening, an exit opening and a side opening communicated with the accommodating space. The insertion opening and the exit opening are disposed at opposite sides of the insulation base. The side opening is located at an outer surface of the insulation base between the insertion opening and the exit opening. The conducting terminal structure is disposed in the insulation base. The conducting terminal structure comprises a first conductive sheet and a second conductive sheet connected to the first conductive sheet. The first conductive sheet and the second conductive sheet are disposed oppositely and formed with an insertion space adjacent to the exit opening for inserting the cable, and the first conductive sheet is extended with a stopping plate adjacent to the insertion opening. The spring plate comprises an abutting section, and one end of the abutting section is abutted against the stopping plate elastically. The elastic handle comprises a clamping portion and a resilience arm connected with the clamping portion. The resilience arm is fixed at the insulation base, and the clamping portion is movably disposed at the side opening and is capable of pressing the abutting section.

Comparing to the prior art, the terminal block of the present invention has provided with elastic handles at a side opening of the insulation base; besides, the conducting terminal structure coupled with a spring plate is combined in the insulation base. Moreover, the resilience arm of the elastic handle is fixed in the insulation base so that the clamping portion is movably disposed at the side opening. In addition, since the elastic handle of the present invention is c the lateral side of the insulation base so that the overall height of the terminal block will not be increased. Furthermore, the plural of elastic handles of the present invention can be integrally formed and connected to each other, thereby the practicability of the present invention can be enhanced.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

Figure 1:
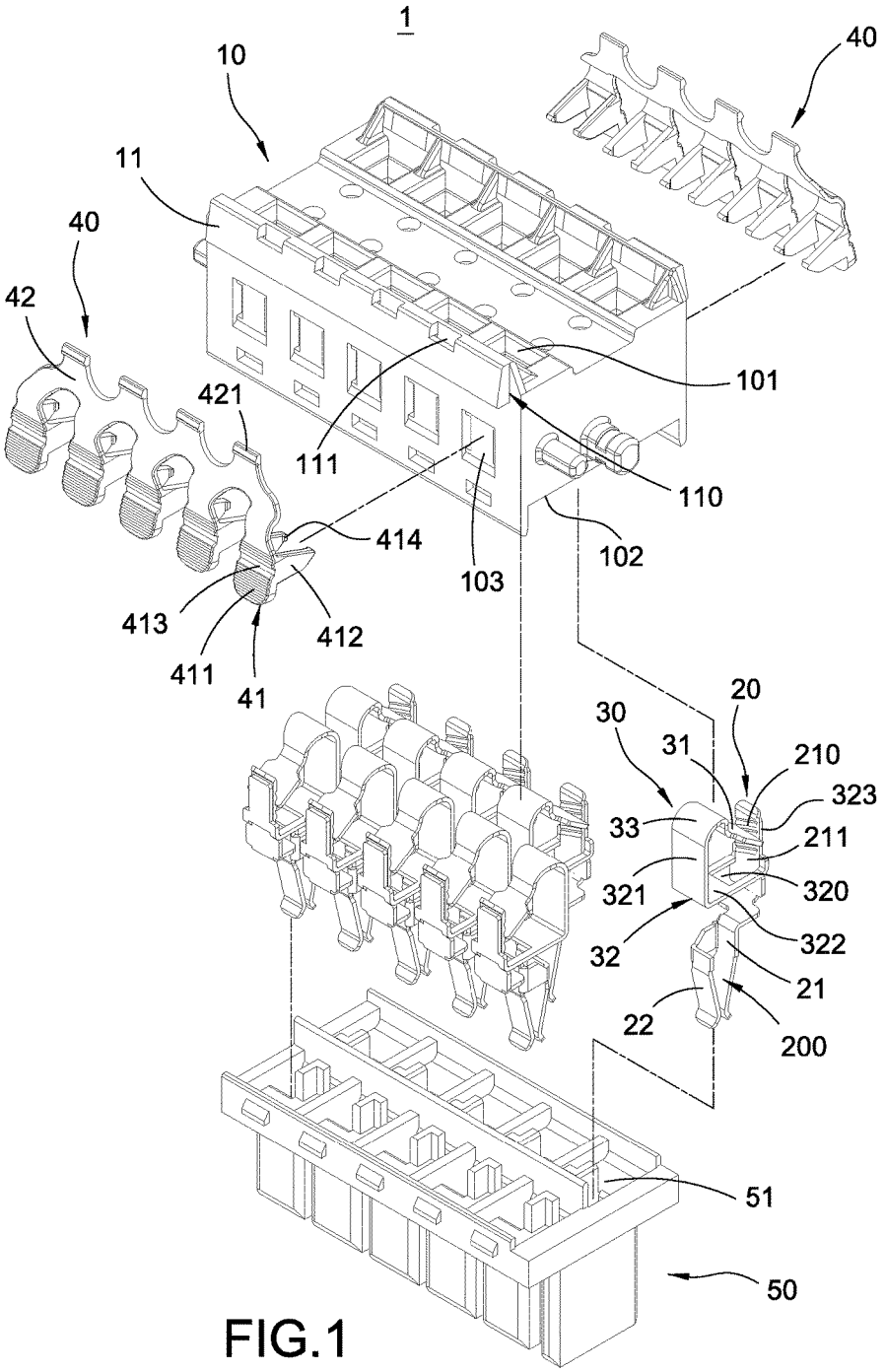
FIG. 1 is an explosion schematic view of the terminal block with lateral elastic handles of the present invention.
Figure 2:
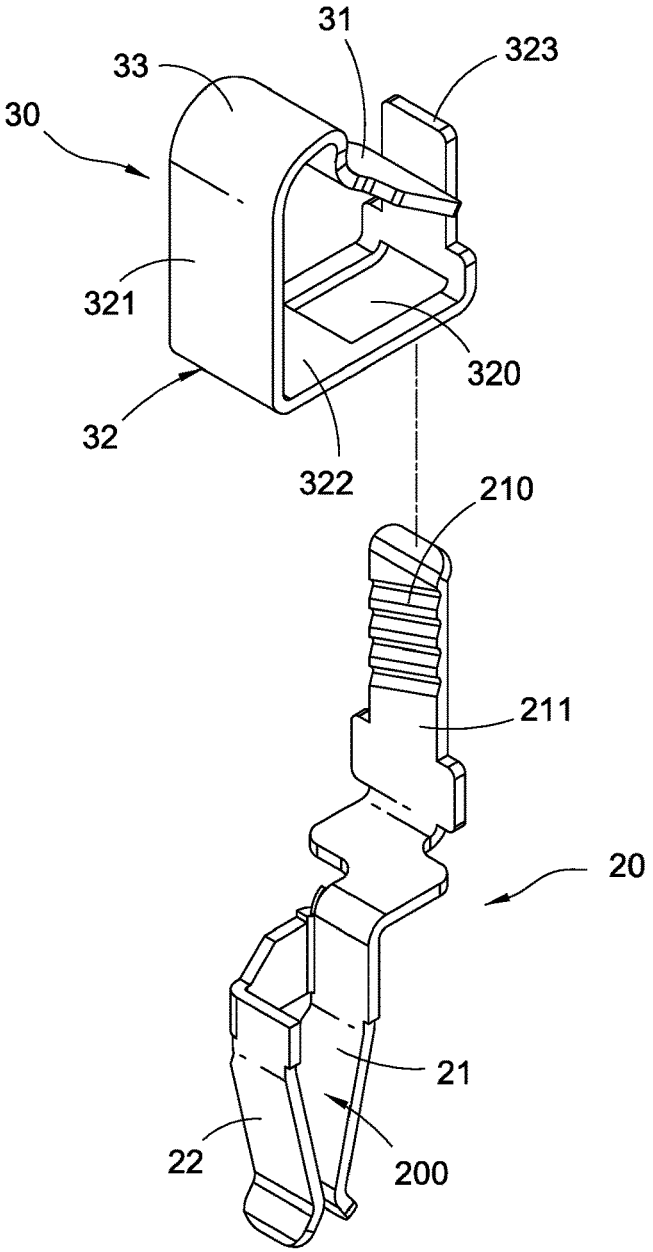
FIG. 2 is an explosion schematic view of the conducting terminal structure of the present invention.

In cooperation with attached drawings, the technical contents and detailed description of the invention are described thereinafter according to a number of preferable embodiments, being not used to limit its executing scope. Any equivalent variation and modification made according to appended claims is all covered by the claims claimed by the present invention.

Please refer to FIG. 1 to FIG. 4, which depict an explosion schematic view of the terminal block with lateral elastic handles of the present invention, an explosion schematic view of the conducting terminal structure, a perspective schematic view and a cross sectional view of the assembly of the terminal block of the present invention. The terminal block 1 with lateral elastic handles of the present invention includes an insulation base 10, at least one conducting terminal structure 20, at least one spring plate 30 and at least one elastic handle 40. The spring plate 30 is combined with the conducting terminal structure 20 and disposed in the insulation base 10 with the conducting terminal structure 20. Besides, the elastic handle 40 is installed at a lateral side of the insulation base 10. More detailed descriptions of the terminal block 1 with lateral elastic handle are as follows.

Figure 4:
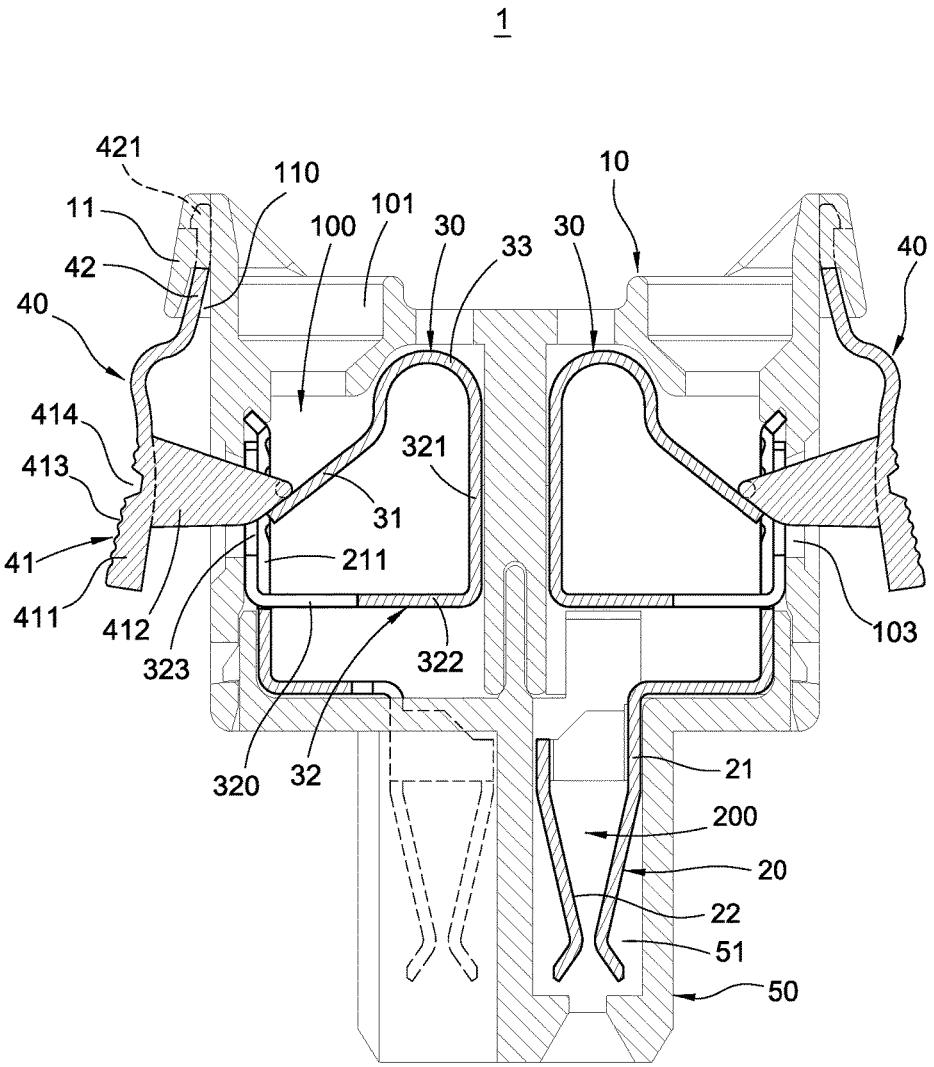
FIG. 4 is a cross sectional view of the terminal block with lateral elastic handles of the present invention.

As shown in FIG. 4, the insulation base 10 has at least one accommodating space 100, and an insertion opening 101, an exit opening 102 and a side opening 103 communicated with the accommodating space 100. The insertion opening 101 and the exit opening 102 are disposed at opposite sides of the insulation base 10, and the side opening 103 is located at an outer surface of the insulation base 10 between the insertion opening 101 and the exit opening 102.

The conducting terminal structure 20 is disposed in the insulation base 10. The conducting terminal structure 20 comprises a first conductive sheet 21 and a second conductive sheet 22 connected to the first conductive sheet 21. The first conductive sheet 21 and the second conductive sheet 22 are disposed oppositely and formed with an insertion space 200 adjacent to the exit opening 102 for inserting the cable 2, and the first conductive sheet 21 is extended with a stopping plate 211 adjacent to the insertion opening 101.

The spring plate 30 comprises an abutting section 31, and one end of the abutting section 31 is abutted against the stopping plate 211 elastically. In one embodiment of the present invention, the spring plate 30 further includes an insertion seat 32 connected with the abutting section 31, and the spring plate 30 is positioned on the conducting terminal structure 20 through the insertion seat 32. Furthermore, the spring plate 30 further includes a connection section 33 located between the abutting section 31 and the insertion seat 32. The connection section 33 is bended and extended from the insertion seat 32 to connect with the abutting section 31, and the abutting section 31 has an elastic force through the connection section 33.

In more detail, a location of the abutting section 31 is corresponded with the insertion opening 101. Preferably, the stopping plate 211 of the first conductive sheet 21 has provided with a plurality of positioning portions 210, and one end of the abutting section 31 can be optionally positioned at one of the positioning portions 210.

Specifically, the insertion seat 32 comprises a supporting segment 321 extended from the connection section 33, a piercing segment 322 bended and extended from the supporting segment 321 and a position segment 323 bended and extended from the piercing segment 322. The piercing segment 322 has a through hole 320, and the through hole 320 is located between the insertion opening 101 and the insertion space 200. Thereby, the positioning section 323 of the spring plate 30 is abutted on the stopping plate 211 through the stopping plate 211 inserted in the through hole 320, and further be positioned on the conducting terminal structure 20. Therefore, when the cable is inserted from the insertion opening 101, the cable passes the through hole 320 and then enters the insertion space 200.

Moreover, the elastic handle 40 comprises a clamping portion 41 and a resilience arm 42 connected with the clamping portion 41. The resilience arm 42 is fixed at the insulation base 10, and the clamping portion 41 is movably disposed at the side opening 103 and is capable of pressing the abutting section 31. Preferably, the resilience arm 42 is configured by a thin wall of plastic for having elastic force.

In more detail, the clamping portion 41 includes a push plate 411 and at least one press plate 412 connected with the push plate 411. The push plate 411 is located outside of the side opening 103 of the insulation base 10, and the press plate 412 is extended into the side opening 103 and abutted against the stopping plate 211 of the first conductive sheet 21. Preferably, an outer surface of the push plate 411 has a plurality of friction ribs 413 and a screwdriver slot 414 provided for positioning a screwdriver (not shown).

In the present embodiment, the terminal block 1 with lateral elastic handle further includes a conductive seat 50 combined in the insulation base 10. The conductive seat 50 has disposed with at least one terminal slot 51; a quantity of the terminal slot 51 is corresponded with the conducting terminal structure 20, and the conducting terminal structure 20 is installed in the terminal slot 51.

Specifically, the quantities of the at least one conducting terminal structure 20, the at least one spring plate 30, the at least one elastic handle 40 and the at least one terminal slot 51 are plural. Furthermore, in the present embodiment, the elastic handles 40 are formed in one piece and connected to each other.

Figure 3:
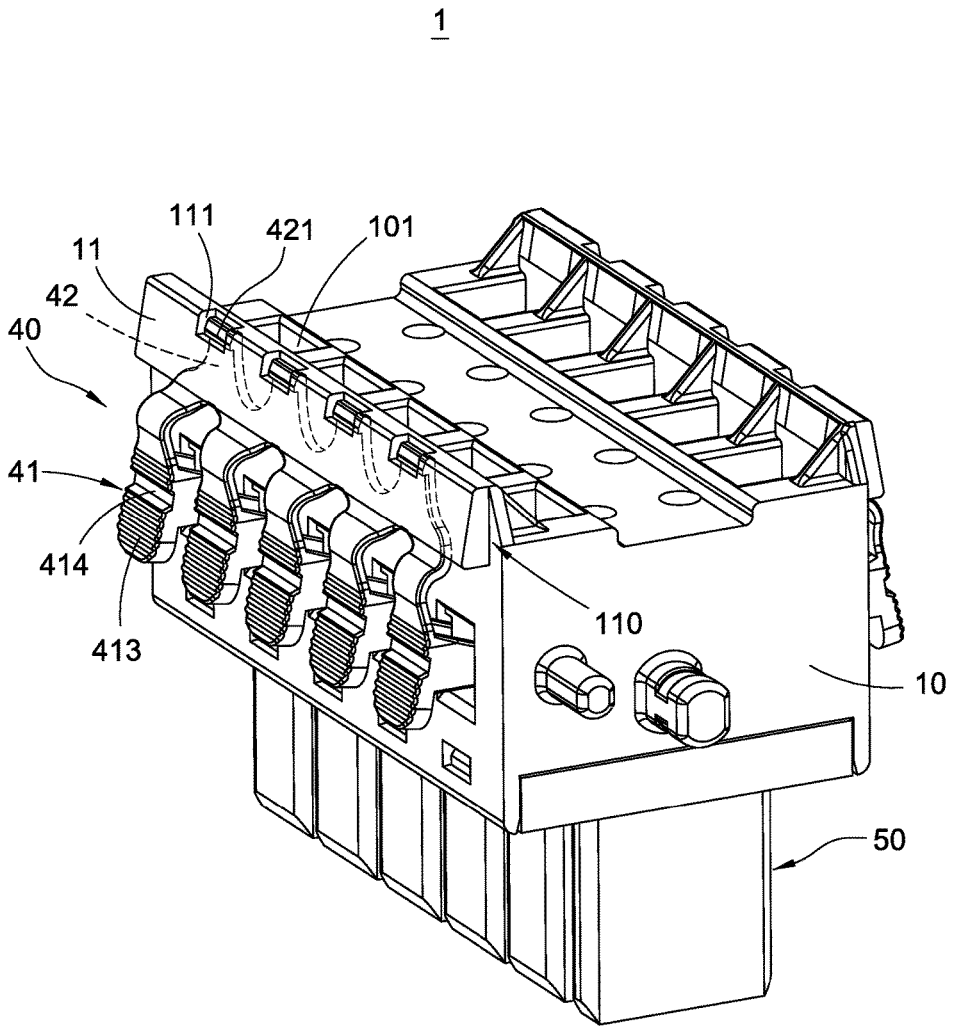
FIG. 3 is a perspective schematic view of the terminal block with lateral elastic handles of the present invention.

As shown in FIG. 3 and FIG. 4, in one embodiment of the present invention, at least one lateral side of the insulation base 10 has a wing plate 11; an insertion space 110 is formed between the wing plate 11 and the insulation base 10, and one end of the resilience arm 42 of the elastic handle 40 is inserted in the insertion space 110. Besides, a top of the wing plate 11 has a slot 111. One end of the resilience arm 42 has a hook 421, and the hook 421 is snapped in the slot 111.

The spring plate 30 is combined with the conducting terminal structure 20 and disposed in the insulation base 10 with the conducting terminal structure 20. Besides, the elastic handle 40 is installed at a lateral side of the insulation base 10. The clamping portion 41 of the elastic handle 40 is movably disposed at the side opening 103 and is capable of pressing the abutting section 31.

Figure 5:
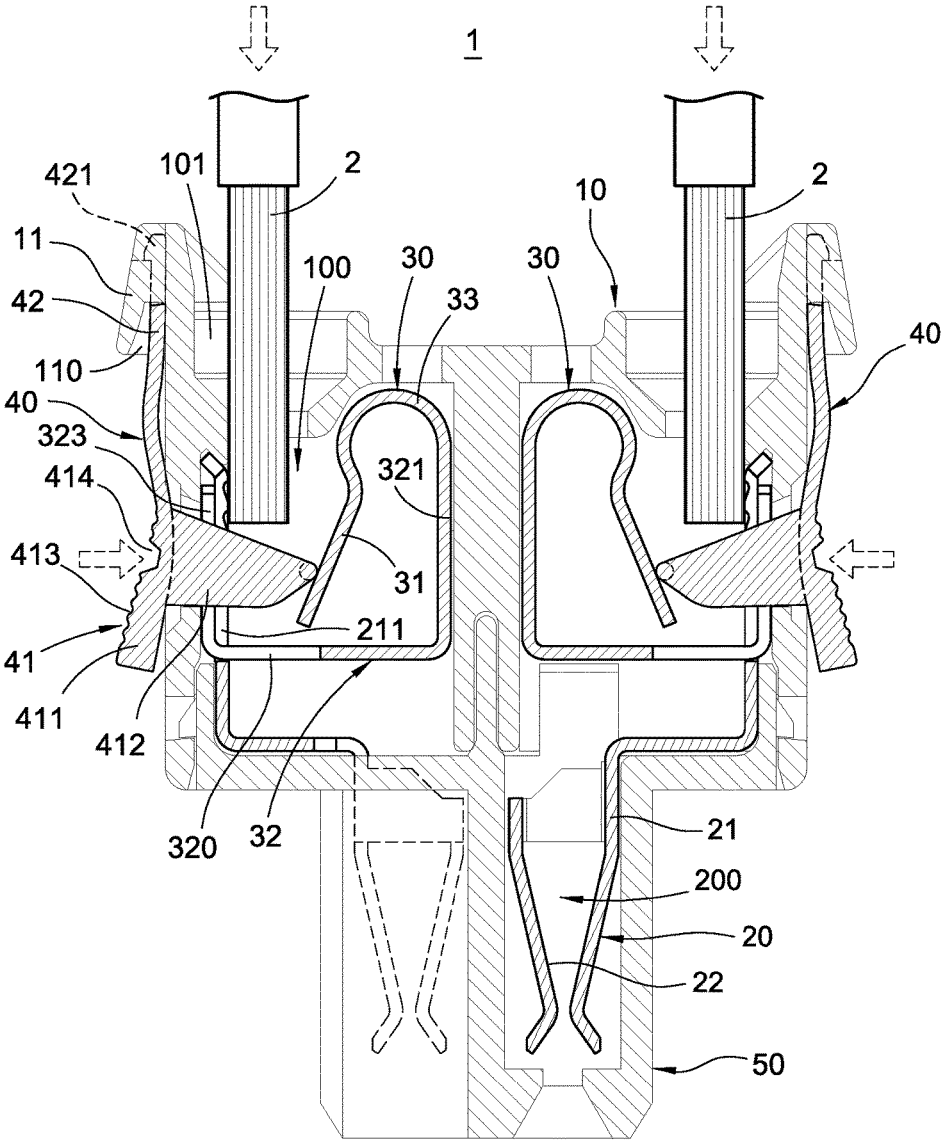
FIG. 5 is cable insertion schematic view of the terminal block with lateral elastic handles of the present invention.
Figure 6:
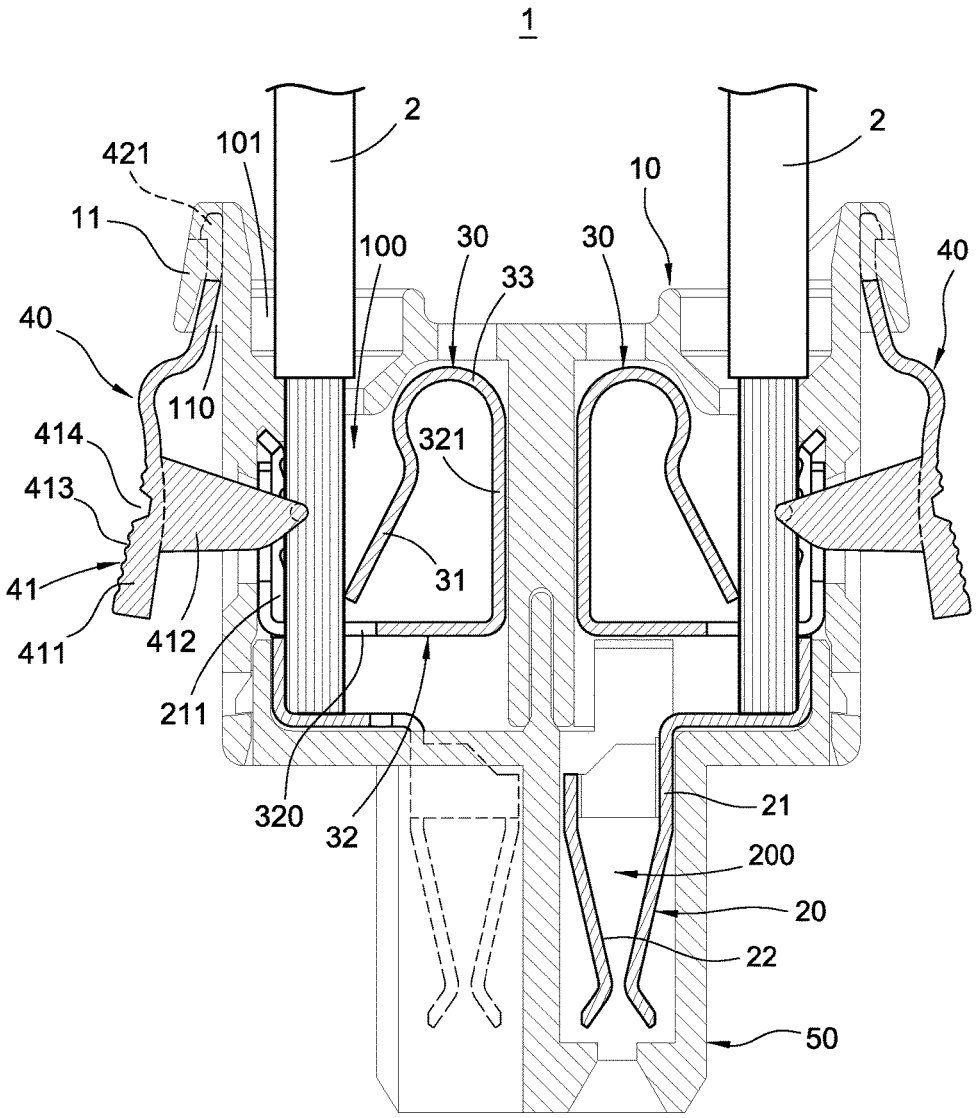
FIG. 6 is another cable insertion schematic view of the terminal block with lateral elastic handles of the present invention.
Figure 7:
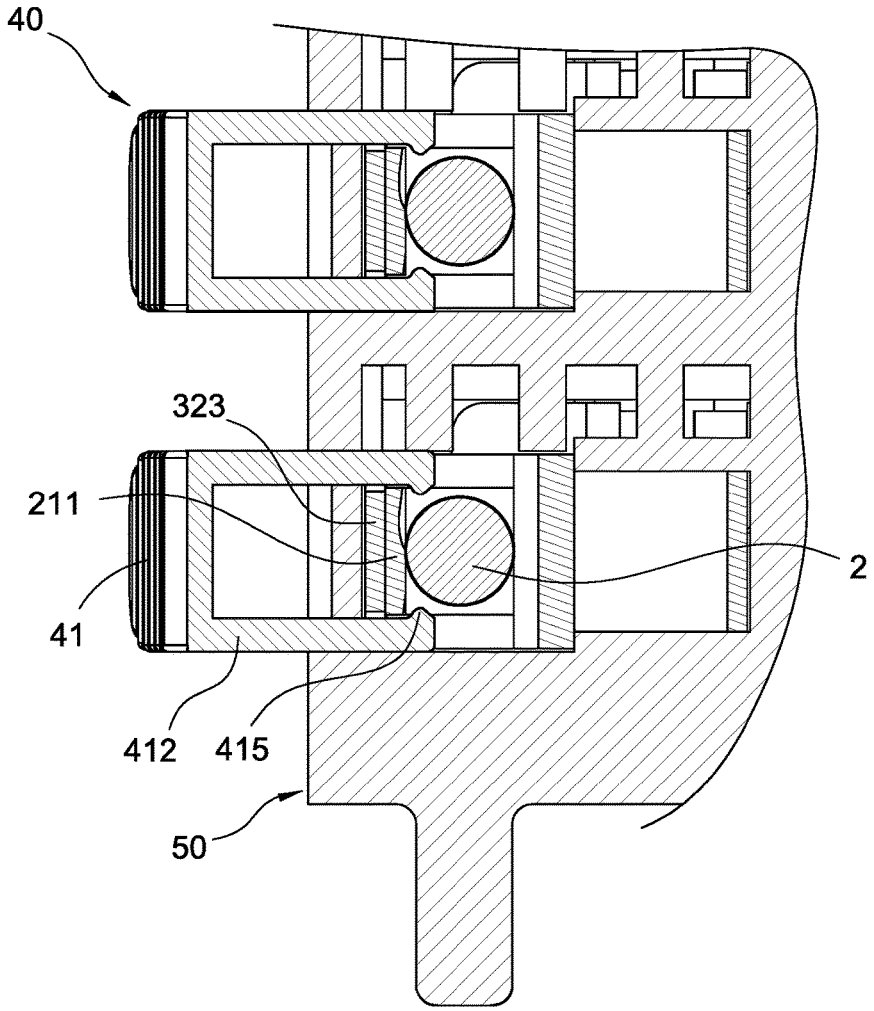
FIG. 7 is a partial cross-sectional view of the terminal block with lateral elastic handles of the present invention.

Please further refer to FIG. 5 to FIG. 7, they depict a schematic view of inserting cable to the terminal block with lateral elastic handles of the present invention, an operating schematic view and a cross sectional view of the present invention. The terminal block 1 with lateral elastic handle of the present invention is provided for inserting at least one cable 2. In real practice, as shown in FIG. 5, the elastic handle 40 can be pressed against the abutting section 31 of the spring plate 30 by an external force so as to facilitate inserting an external cable into the insulating base 10 and electrically connect with the conducting terminal structure 20.

Furthermore, please refer to FIG. 6, when the cable 2 is inserted into the terminal structure 20 from the insertion opening 101, the cable 2 passes the pressure plate 412 and the abutting section 31; then the cable 2 passes through the through hole 320, and will be stopped on the first conductive sheet 21 at last. Thereby, the cable 2 will be electrically connected with the conducting terminal structure 20.

It is worthy of notice that, subsequently, another electronic device can be electrically connected by inserting its wires into the insertion space 200 of the conducting terminal structure 20.

Moreover, please also refer to FIG. 7, in the present embodiment, an end of the press plate 412 of the elastic handle 40 has a bump 415; and the bump 415 is clamped with the conducting terminal structure 20 (the stopping plate 211 and the position segment 323) so that the pressure plate 412 will not disengage from the insulation base 10.

Figure 8:
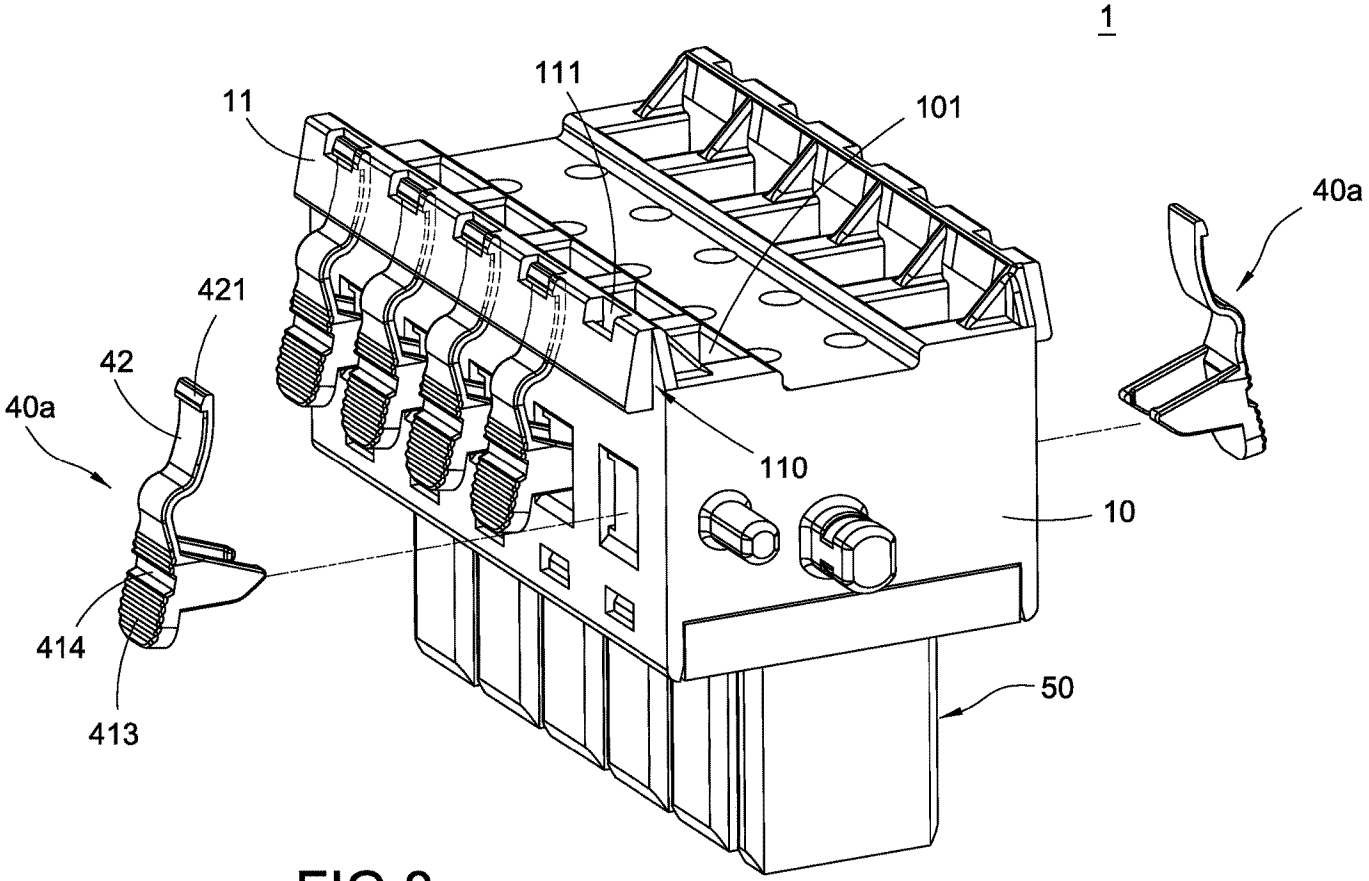
FIG. 8 is another embodiment of the terminal block with lateral elastic handles of the present invention.

With referring to FIG. 8, it depicts another embodiment of the terminal block with lateral elastic handles. The difference in this embodiment lies in the configuration of the elastic handle. In the present embodiment, the terminal block 1 has provided with a plurality of elastic handles 40*a*, but the elastic handles 40 are formed separately which are different from the previous embodiment in which the elastic handles are integral formed in one piece and connected to each other.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. A terminal block with lateral elastic handles for inserting at least one cable, comprising an insulation base (10) having at least one accommodating space (100), and an insertion opening (101), an exit opening (102) and a side opening (103) communicated with the accommodating space (100); the insertion opening (101) and the exit opening (102) disposed at opposite sides of the insulation base (10); the side opening (103) located at an outer surface of the insulation base (10) between the insertion opening (101) and the exit opening (102);

at least one conducting terminal structure (20) disposed in the insulation base (10), the conducting terminal structure (20) comprising a first conductive sheet (21) and a second conductive sheet (22) connected to the first conductive sheet (21); the first conductive sheet (21) and the second conductive sheet (22) disposed oppositely and formed with an insertion space (200) adjacent to the exit opening (102) for inserting the cable (2), and the first conductive sheet (21) extended with a stopping plate (211) adjacent to the insertion opening (101);

at least one spring plate (30) comprising an abutting section (31), and one end of the abutting section (31) abutted against the stopping plate (211) elastically; and at least one elastic handle (40) comprising a clamping portion (41) and a resilience arm (42) connected with the clamping portion (41); the resilience arm (42) fixed to the insulation base (10), and the clamping portion (41) movably disposed at the side opening (103) and being capable of pressing the abutting section (31).

2. The terminal block with lateral elastic handles according to claim 1, further including a conductive seat (50) combined in the insulation base (10), wherein the conductive seat (50) has disposed with at least one terminal slot (51), and a quantity of the terminal slot (51) is corresponded with the conducting terminal structure (20); the conducting terminal structure (20) is installed in the terminal slot (51).

3. The terminal block with lateral elastic handles according to claim 2, wherein a quantity of the at least one conducting terminal structure (20), the at least one spring plate (30), the at least one elastic handle (40) and the at least one terminal slot (51) is plural.

4. The terminal block with lateral elastic handles according to claim 3, wherein the elastic handles (40) are formed in one piece and connected to each other.

5. The terminal block with lateral elastic handles according to claim 3, wherein the elastic handles (40) are formed separately.

6. The terminal block with lateral elastic handles according to claim 1, wherein the stopping plate (211) has provided with a plurality of positioning portions (210), and one end of the abutting section (31) can be optionally positioned at one of the positioning portions (210).

7. The terminal block with lateral elastic handles according to claim 1, wherein the spring plate (30) further includes an insertion seat (32) connected with the abutting section (31), and the spring plate (30) is positioned on the conducting terminal structure (20) through the insertion seat (32).

8. The terminal block with lateral elastic handles according to claim 7, wherein the spring plate (30) further includes a connection section (33) located between the abutting section (31) and the insertion seat (32); the connection section (33) is bended and extended from the insertion seat (32) to connect with the abutting section (31), and the abutting section (31) has an elastic force through the connection section (33).

9. The terminal block with lateral elastic handles according to claim 8, wherein the insertion seat (32) comprises a supporting segment (321) extended from the connection section (33), a piercing segment (322) bended and extended from the supporting segment (321) and a position segment (323) bended and extended from the piercing segment (322); the piercing segment (322) has through hole (320); the through hole (320) is located between the insertion opening (101) and the insertion space (200), and the stopping plate (211) is inserted in the through hole (320).

10. The terminal block with lateral elastic handles according to claim 1, wherein a location of the abutting section (31) is corresponded with the insertion opening (101).

11. The terminal block with lateral elastic handles according to claim 1, wherein at least one lateral side of insulation base (10) has a wing plate (11); an insertion space (110) is formed between the wing plate (11) and the insulation base (10), and one end of the resilience arm (42) is inserted in the insertion space (110).

12. The terminal block with lateral elastic handles according to claim 11, wherein a top of the wing plate (11) has a slot (111); one end of the resilience arm (42) has a hook (421), and the hook (421) is snapped in the slot (111).

13. The terminal block with lateral elastic handles according to claim 1, wherein the clamping portion (41) includes a push plate (411) and at least one press plate (412) connected with the push plate (411); the push plate (411) is located outside of the side opening (103), and the press plate (412) is extended into the side opening (103) and abutted against the stopping plate (211).

14. The terminal block with lateral elastic handles according to claim 13, wherein an outer surface of the push plate (411) has a plurality of friction ribs (413).

15. The terminal block with lateral elastic handles according to claim 13, wherein an outer surface of the push plate (411) has a screwdriver slot (414) provided for positioning a screwdriver.

16. The terminal block with lateral elastic handles according to claim 13, wherein an end of the press plate (412) has a bump (415), and the bump (415) is clamped with the conducting terminal structure (20) so that the press plate (412) will not disengage from the insulation base (10).

17. The terminal block with lateral elastic handles according to claim 1, wherein the resilience arm (42) is configured by a thin wall of plastic.

* * * * *